US005480073A

United States Patent [19]

LaManna

[11] Patent Number: 5,480,073

[45] Date of Patent: Jan. 2, 1996

[54] CAP HOLDER APPARATUS

[76] Inventor: Frank A. LaManna, 21 Rockmeadow Rd., Norwalk, Conn. 06850

[21] Appl. No.: 270,595

[22] Filed: Jul. 5, 1994

[51] Int. Cl.[6] ..... A41H 43/00; D06C 15/00; A47F 7/06; B65D 85/02

[52] U.S. Cl. ..... 223/1; 223/84; 211/30; 211/32; 206/303

[58] Field of Search ..... 223/1, 24, 25, 223/26, 84; 206/303, 449, 335; 211/30, 31, 32, 33

[56] References Cited

U.S. PATENT DOCUMENTS

| | | | |
|---|---|---|---|
| D. 269,486 | 6/1983 | Marrs . | |
| D. 299,989 | 2/1989 | Burr . | |
| 484,085 | 10/1892 | Caspar | 211/32 |
| 1,449,698 | 3/1923 | Roragen et al. | 211/32 |
| 1,608,758 | 11/1926 | Alexander | 211/30 |
| 3,524,538 | 8/1970 | Marlowe | 206/303 |
| 3,858,769 | 1/1975 | Billingsea, Jr. | 223/84 |
| 4,927,063 | 5/1990 | Fricano | 223/84 |
| 5,033,660 | 7/1991 | Kelly . | |
| 5,038,941 | 8/1991 | Bastiaansen | 211/32 |
| 5,082,121 | 1/1992 | Grubb . | |
| 5,137,157 | 8/1992 | Lawson | 211/32 |
| 5,188,325 | 2/1993 | Hilty | 211/32 |

FOREIGN PATENT DOCUMENTS

| | | | |
|---|---|---|---|
| 2617140 | 12/1988 | France | 206/303 |
| 26613 | 11/1911 | United Kingdom | 223/24 |

*Primary Examiner*—C. D. Crowder
*Assistant Examiner*—Bibhu Mohanty

[57] ABSTRACT

A cap holder apparatus includes a base assembly adapted to be attached to a support surface. A plurality of clamp members project from the top surface of the base assembly. Each of the clamp members includes a round contour adapted to contact a round contour on a head covering such as a cap or hat. The clamp members are arrayed on the base assembly such that free ends of the clamp members are parallel to each other. Fasteners or an adhesive are provided for attaching the base assembly to a support surface. The clamp members are in a form of portions of walls of a cylinder, and the clamp members are concentric to each other. Apertures may be provided in the base assembly to receive screws for attaching the base assembly to a support surface. If an adhesive layer, located on the bottom surface of the base assembly, is employed, a non-adhesive barrier layer is placed upon the layer of adhesive material until the adhesive layer is ready for use, upon which time the barrier layer is removed. With another embodiment, the clamp members are resilient and project from the base assembly such that the free ends of the clamp members converge toward each other.

6 Claims, 4 Drawing Sheets

CAP HOLDER APPARATUS

BACKGROUND OF THE INVENTION

1. Field of the Invention

The present invention relates generally to cap holders and, more particularly, to cap holders especially adapted for installation on vertical surfaces such as in closets.

2. Description of the Prior Art

Head coverings come in many shapes and sizes, but one thing most head coverings have in common is a round head band portion that fits circumferentially around a wearer's head when the head covering is worn. Some head coverings, oftentimes referred to as caps, also have round visor portions that project outward from the head band.

A variety of holders are known for holding head coverings when the head coverings are not in use. Commonly known holders include hooks that are fixed to vertical surfaces. Hooks generally include thin, rod-like projections upon which a head covering is held. When a head covering is hung from a rod-like hook, gravity pulls down on the head covering causing the head covering to be pulled out of its normally round shape. In this respect, it would be desirable if a holder for a head covering were provided which tends to maintain the head covering in normal shape as the head covering is hung from the holder.

Head coverings, especially visor containing caps, often have indicia which face forward in the direction of the visor. However, when such a cap is placed on a rod-like hook, the indicia is often not readily ascertained. When a plurality of caps are owned, each bearing different indicia, it would be desirable to be able to readily ascertain the indicia so as to facilitate selection of a desired cap.

To install a holder for a head covering on a vertical surface, it would be desirable to be able to select whether a mechanical fastener, such as a screw, or an adhesive were used. It may even be desirable to be able to employ both a mechanical fastener and an adhesive to mount a holder for a head covering on a vertical surface.

A rod-like hook utilizes the force of gravity to retain a head covering on the hook. Instead of relying solely upon the passive force of gravity, it would be desirable if a head covering holder were provided that employed a positive clamping action to retain the head covering on the holder.

Throughout the years, a number of innovations have been developed relating to holders for head coverings, and the following U.S. patents are representative of some of those innovations: U.S. Pat. Nos. 4,927,063; 5,033,660; 5,082,121; Des. 269,486; and Des. 299,989.

More specifically, U.S. Pat. No. 4,927,063 discloses a combination cap hanger and visor press which requires a user to use one hand to spread clamping jaws, to use the other hand to insert a cap visor between the spread jaws, and to release the spread jaws by removing the first hand. For purposes of simplicity and efficiency, it would be desirable if a visor of a cap could be installed in a visor clamp using a one-handed operation.

U.S. Pat. No. 5,033,660 discloses a wire hanger for hanging hats which includes a U-shaped ring which extends substantially the full length of the hat being held. Such a U-shaped ring requires quite a bit of material and takes up quite a bit of space when not in use. In this respect, it would be desirable if a holder for a head covering were provided which does not use much material and does not take up much space when not in use.

U.S. Pat. No. 5,082,121 discloses a portable hat caddy for holding a hat substantially in a wearing position. A complex leverage system is employed to outwardly spread two clamping jaws to engage 180 degree opposing portions of the head band. Such a device uses quite a bit of material and takes up quite a bit of space when not in use. It would be desirable if a holder for a head covering did not employ a complex leverage system for expanding clamping jaws.

U.S. Pat. No. Des. 269,486 discloses another hat holder which employs two clamping jaws that are outwardly spread to engage 180 degree opposing portions of a head band of a head covering. U.S. Pat. No. Des. 299,989 discloses a hat stand which appears to employ a hemispherical, hat-receiving member which simulates the size and shape of a head.

Still other features would be desirable in a cap holder apparatus. For example, not all hat visors have the same thickness. Therefore, it would be desirable if a holder for a head covering had a visor-clamping portion that was adapted to clamp onto different visors having different thicknesses. In addition, it would be desirable if a holder for a head covering were stackable and could, alternatively, be installed on a closet pole. Moreover, it would be desirable if a holder for a head covering could be easily installed on a wide variety of racks either mass produced or custom made.

Thus, while the foregoing body of prior art indicates it to be well known to use holders for caps or other head coverings, the prior art described above does not teach or suggest a head covering holder apparatus which has the following combination of desirable features: (1) tends to maintain the head covering in normal shape as the head covering is hung from the holder; (2) enables a person to readily ascertain indicia on a cap so as to facilitate selection of a desired cap; (3) enables a person to select whether a mechanical fastener, such as a screw, or an adhesive is used to install the head covering support on a vertical surface; (4) can employ both a mechanical fastener and an adhesive to mount a head covering holder on a vertical surface; (5) employs a positive clamping action to retain the head covering on the holder; (6) enables a person to install a visor in a visor clamp using a one-handed operation; (7) does not use much material and does not take up much space when not in use; (8) does not employ a complex leverage system for expanding clamping jaws; (9) has a visor-clamping portion that is adapted to clamp onto different visors having different thicknesses; (10) is stackable and could, alternatively, be installed on a closet pole; and (11) can be easily installed on a wide variety of racks either mass produced or custom made. The foregoing desired characteristics are provided by the unique cap holder apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a cap holder apparatus which includes a base assembly adapted to be attached to a support surface. The base assembly includes a top surface and a bottom surface. A plurality of clamp members project from the top surface of the base assembly. Each of the clamp members includes a round contour adapted to contact a round contour on a head covering. The clamp members are arrayed on the base assembly such that free ends of the clamp members are parallel to each other. Attaching means are provided for attaching the base assembly to a support surface. The base assembly is substantially planar and is adapted to be attached to a substantially planar support surface juxtaposed to the bottom surface of the base assembly.

The clamp members are in a form of portions of walls of a cylinder, and the clamp members are concentric to each other. The attaching means may include apertures in the base assembly adapted to receive a mechanical fastener, e.g. a screw, for attaching the base assembly to a support surface. The attaching means may also include a layer of adhesive material located on the bottom surface of the base assembly. A non-adhesive barrier layer is placed upon the layer of adhesive material until the adhesive layer is ready for use, upon which time the barrier layer is removed.

In accordance with another embodiment of the invention, the clamp members are resilient and project from the base assembly such that the free ends of the clamp members converge toward each other.

In accordance with another aspect of the invention, the base assembly includes an array of wells. Each of the clamp members includes a peg portion adapted to be inserted into a selected well. In use, the array of wells can be in a vertical linear array. Clamp members can be located at any selected positions along the linear array. Moreover, more or less pairs of clamp members can be employed to accommodate more or less caps, as desired. In essence, the clamp members serve as modules that can be supported via their respective peg portions in the wells of the base assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cap holder apparatus which has all of the advantages of the prior art and none of the disadvantages.

It is another object of the present invention to provide a new and improved cap holder apparatus which may be easily and efficiently manufactured and marketed.

It is a further object of the present invention to provide a new and improved cap holder apparatus which is of durable and reliable construction.

An even further object of the present invention is to provide a new and improved cap holder apparatus which is susceptible of a low cost of manufacture with regard to both materials and labor, and which accordingly is then susceptible of low prices of sale to the consuming public, thereby making such cap holder apparatus available to the buying public.

Still yet a further object of the present invention is to provide a new and improved cap holder apparatus which tends to maintain the head covering in normal shape as the head covering is hung from the holder.

Still another object of the present invention is to provide a new and improved cap holder apparatus that enables a person to readily ascertain indicia on a cap so as to facilitate selection of a desired cap.

Yet another object of the present invention is to provide a new and improved cap holder apparatus which enables a person to select whether a mechanical fastener, such as a screw, or an adhesive is used to install the head covering support on a vertical surface.

Even another object of the present invention is to provide a new and improved cap holder apparatus that can employ both a mechanical fastener and an adhesive to mount a head coveting holder on a vertical surface.

Still a further object of the present invention is to provide a new and improved cap holder apparatus which employs a positive clamping action to retain the head covering on the holder.

Yet another object of the present invention is to provide a new and improved cap holder apparatus that enables a person to install a visor in a visor clamp using a one-handed operation.

Still another object of the present invention is to provide a new and improved cap holder apparatus which does not use much material and does not take up much space when not in use.

An even further object of the present invention is to provide a new and improved cap holder apparatus that does not employ a complex leverage system for expanding clamping jaws.

Still a further object of the present invention is to provide a new and improved cap holder apparatus that has a visor-clamping portion that is adapted to clamp onto different visors having different thicknesses.

Yet another object of the present invention is to provide a new and improved cap holder apparatus which is stackable and could, alternatively, be installed on a closet pole.

Still yet a further object of the present invention is to provide a new and improved cap holder apparatus that can be easily installed on a wide variety of racks either mass produced or custom made.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved cap holder apparatus embodying the principles and concepts of the present invention will be described.

Figure 1:
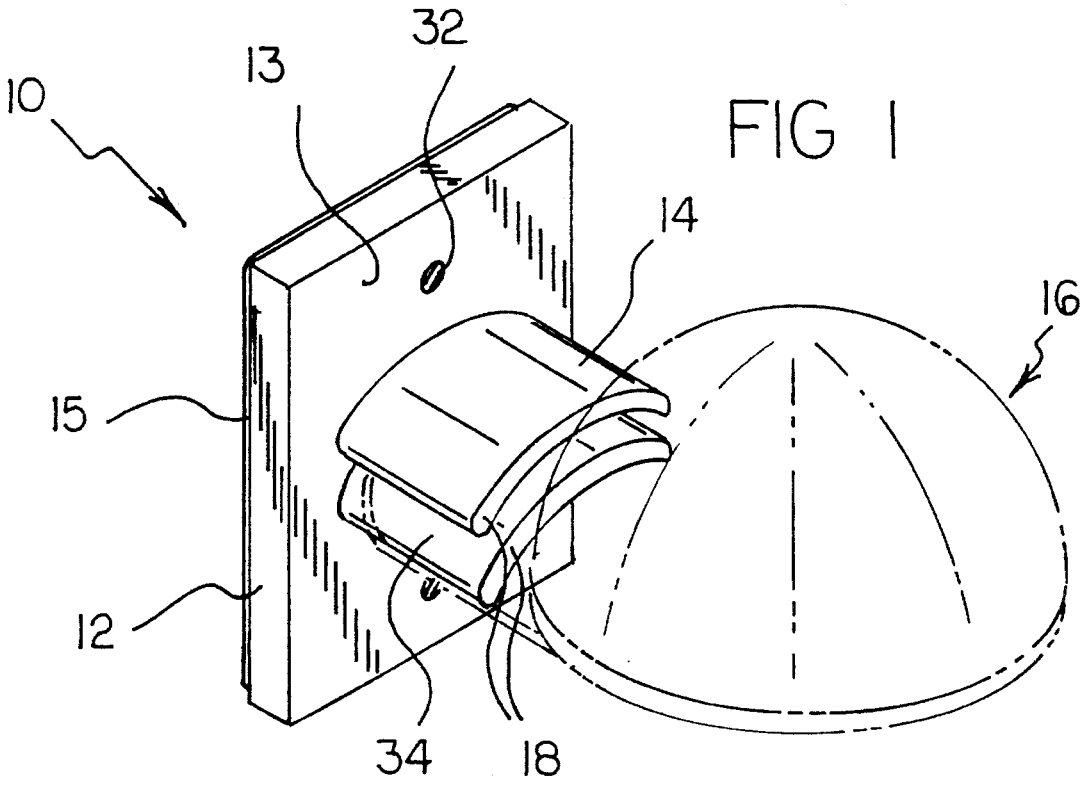
FIG. 1 is a perspective view showing a preferred embodiment of the cap holder apparatus of the invention with a visor of a cap installed in the holder.
Figure 2:
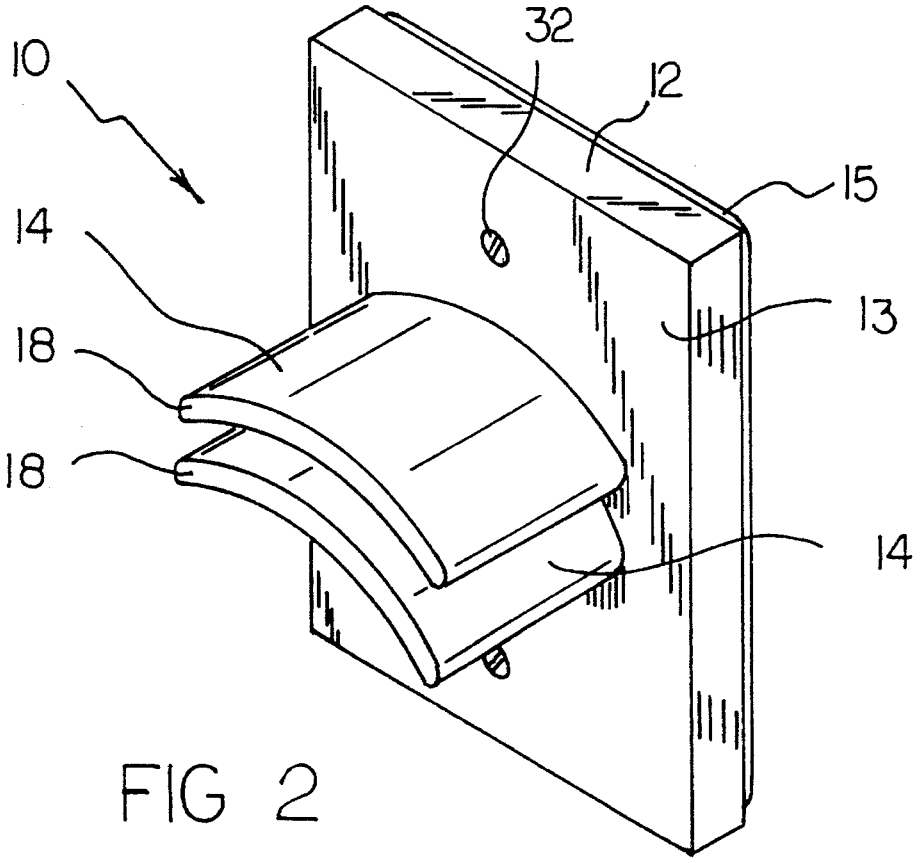
FIG. 2 is an enlarged perspective view of the embodiment of the cap holder apparatus shown in FIG. 1.
Figure 3:
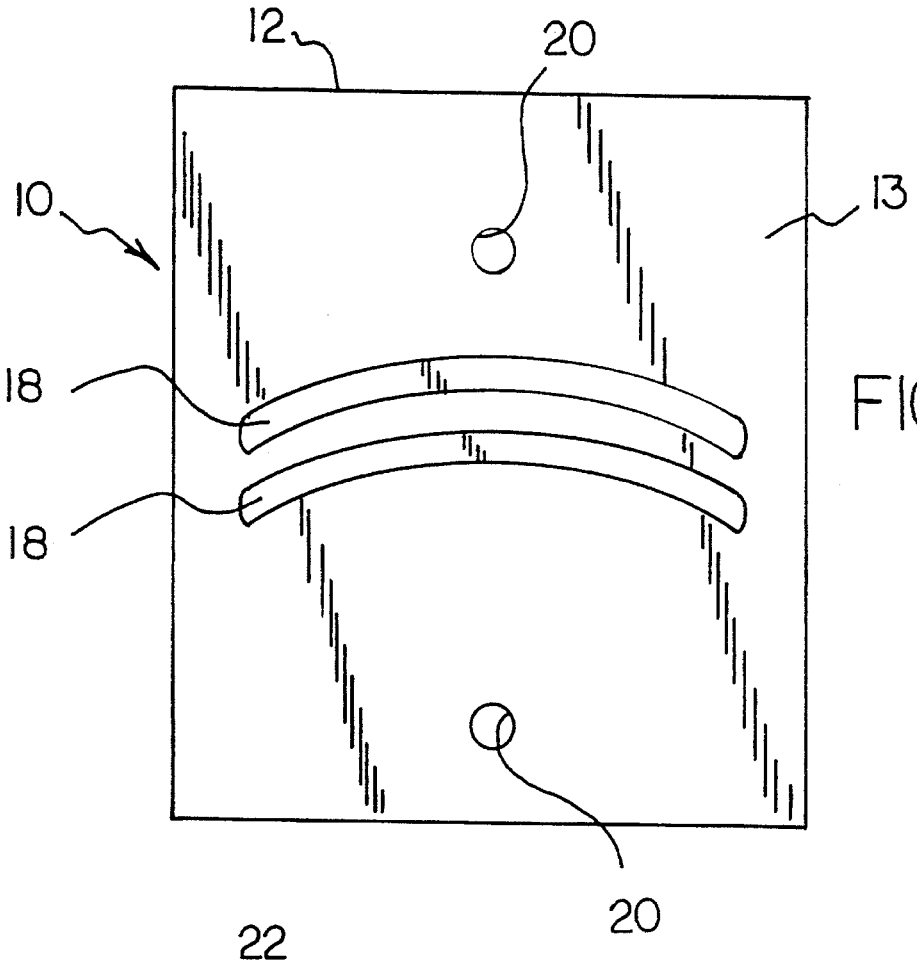
FIG. 3 is an enlarged front view of the embodiment of the cap holder apparatus of FIG. 2.

Turning to FIGS. 1–4, there is shown a first exemplary embodiment of the cap holder apparatus of the invention generally designated by reference numeral 10. In this embodiment, cap holder apparatus 10 includes a base assembly 12 adapted to be attached to a support surface. The base assembly 12 includes a top surface 13 and a bottom surface 15. A plurality of clamp members 14 project from the top surface 13 of the base assembly 12. Each of the clamp members 14 includes a round contour adapted to contact a round contour on a head covering 16. The clamp members 14 are arrayed on the base assembly 12 such that free ends 18 of the clamp members 14 are parallel to each other. Attaching means are provided for attaching the base assembly 12 to a support surface. As shown in FIG. 1, a visor 34 of a cap 16 is placed between the clamp members 14. The base assembly 12 is substantially planar and is adapted to be attached to a substantially planar support surface juxtaposed to the bottom surface 15 of the base assembly 12.

In FIGS. 1–4, the clamp members 14 are in a form of portions of walls of a cylinder, and the clamp members 14 are concentric to each other. The attaching means includes apertures 20 in the base assembly 12 adapted to receive a mechanical fastener, e.g. a screw 32, for attaching the base assembly 12 to a support surface. The mechanical fasteners can be conventional screws, nails, expansion bolts, or the like.

Figure 4:
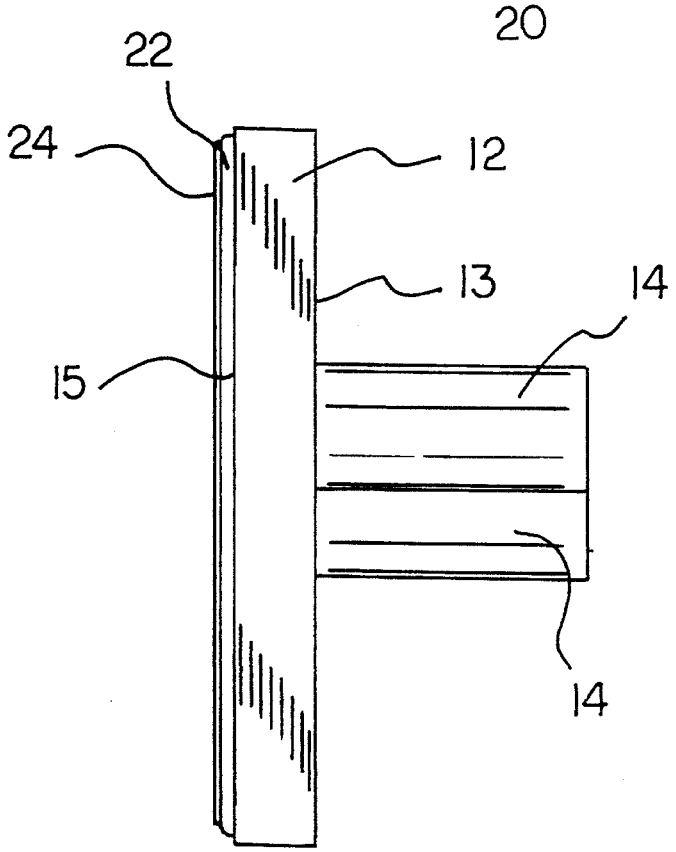
FIG. 4 is a side view of the embodiment of the invention shown in FIG. 3.

As shown in greatest detail in FIG. 4, the attaching means may include a layer of adhesive material 22 located on the bottom surface 15 of the base assembly 12. A non-adhesive barrier layer 24 is placed upon the layer of adhesive material 22.

In use, the non-adhesive barrier layer 24, which may be an adhesive-repellent paper, is pulled off of the layer of adhesive material 22 prior to installation of the cap holder apparatus 10 on the support surface. Suitable adhesives are adhesives that are currently employed for self-adhering hook assemblies that are well known and readily available. Suitable non-adhesive barrier layers 24 can also be like ones used with self-adhering hook assemblies. If desired, both mechanical fasteners and an adhesive layer can be used simultaneously for attaching the cap holder apparatus 10 of the invention to a support surface. The support surface can be vertically oriented such as a wall or a vertical side of a board or a vertically extending pole. The support surface can also be horizontally or obliquely oriented.

Figure 5:
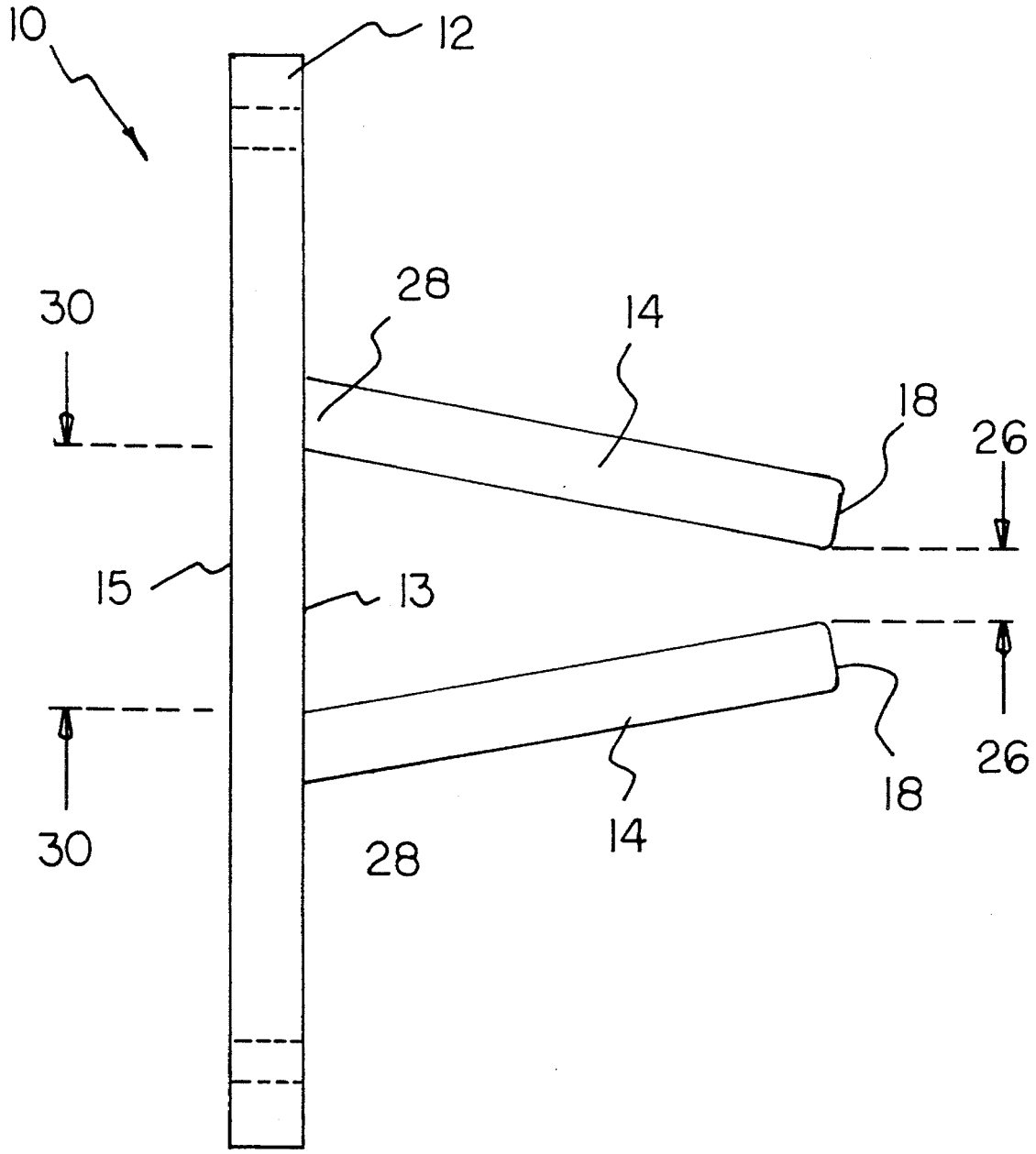
FIG. 5 is a side view of a second embodiment of the cap holder apparatus of the invention showing converging clamping members.

Turning to FIG. 5, a second embodiment of the invention is shown. Reference numerals are shown that correspond to like reference numerals that designate like elements shown in the other figures. More specifically, the clamp members 14 are resilient and project from the base assembly 12 such that the free ends 18 of the clamp members 14 converge toward each other. With this embodiment, the free ends 18 of the clamp members 14 are separated by a first distance 26, and the base ends 28 of the clamp members 14 are separated by a second distance 30. The first distance 26 is less than the second distance 30 whereby the clamp members 14 converge.

With this embodiment of the invention, visors or head bands of a variety of thicknesses can be easily accommodated by the cap holder apparatus 10 of the invention. In use, a visor 34 or head band is pushed between the free ends 18 of the clamp members 14 causing them to spread and exert a resilient clamping action on the respective visor or head band. The clamp members 14 can be made from resilient plastic materials, e.g. polyethylene, or from resilient metal.

Figure 6:
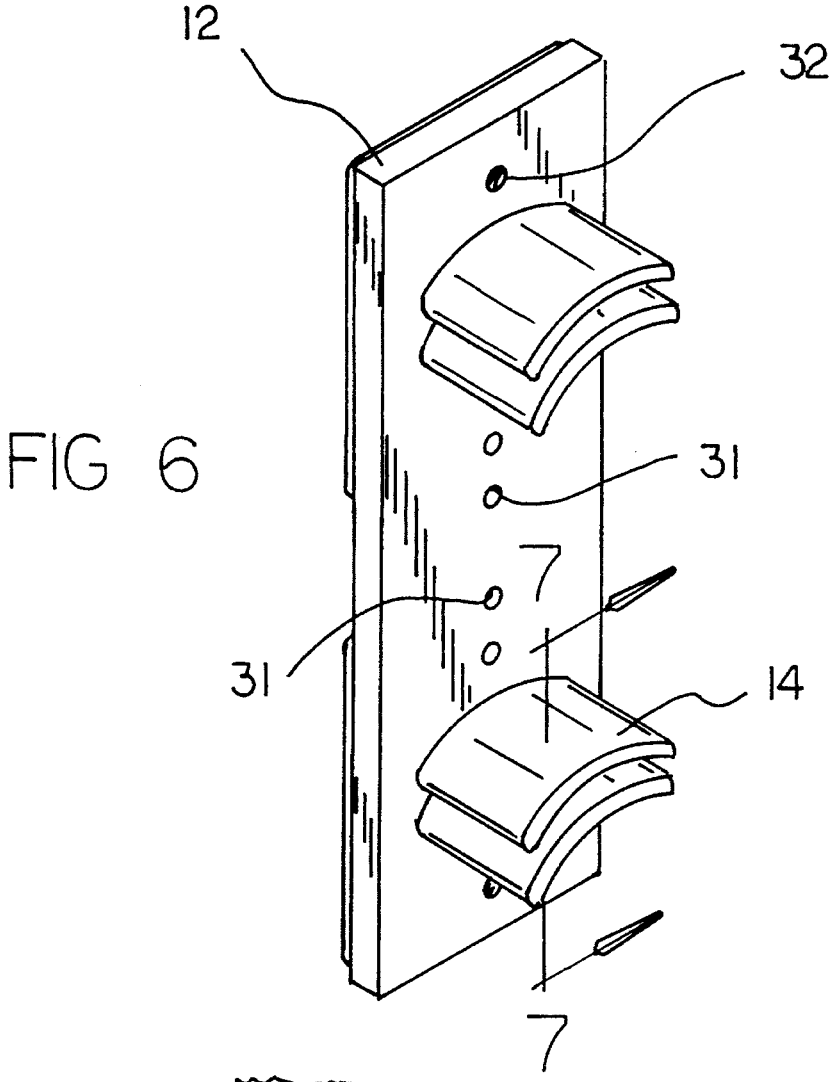
FIG. 6 is a perspective view showing another preferred embodiment of the cap holder apparatus of the invention.
Figure 7:
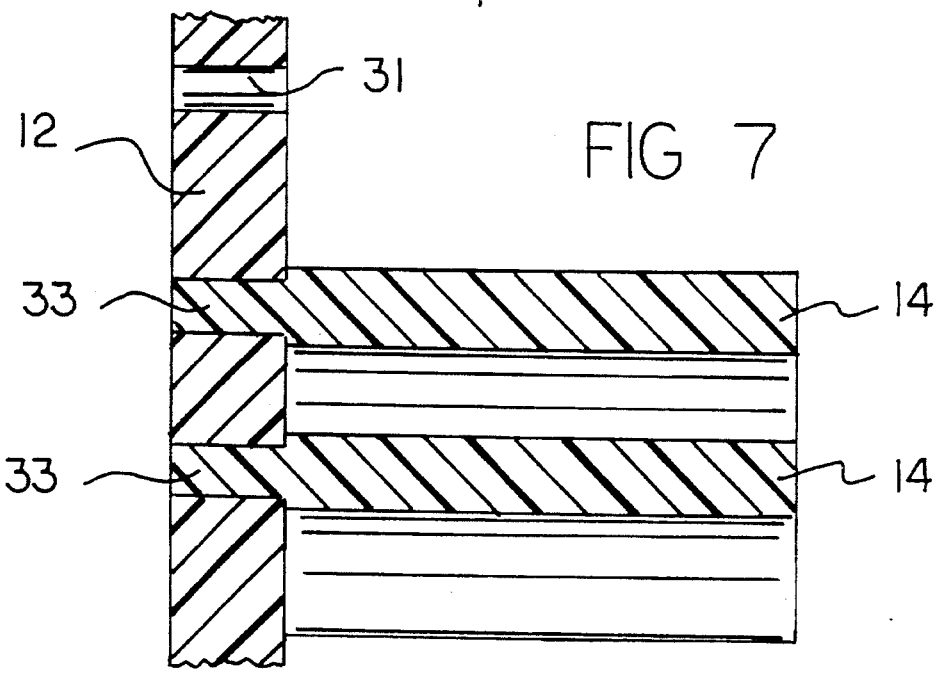
FIG. 7 is an enlarged cross-sectional view of the portion of the embodiment shown in FIG. 6 taken along line 7—7 in FIG. 6.

Turning to FIGS. 6 and 7, yet another embodiment of the invention is shown. In this embodiment, the base assembly 12 includes an array of wells 31. Each of the clamp members 14 includes a peg portion 33 adapted to be inserted into a selected well 31. In use, the array of wells 31 can be in a vertical linear array. Clamp members 14 can be located at any selected positions along the linear array. Moreover, more or less pairs of clamp members 14 can be employed to accommodate more or less caps, as desired. In essence, the elmrip members 14 serve as modules that can be supported via their respective peg portions 33 in the wells 31 of the base assembly 12.

As clear from the above description, the cap holder apparatus 10 of the invention can be used for a wide variety of head coverings whether they are called caps, hats, visors, or the like. For purposes of the present invention, the term "cap" is understood to includes caps, hats, visors, and the like.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved cap holder apparatus that is low in cost, relatively simple in design and operation, and which may advantageously be used to maintain a head covering in normal shape as the head covering is hung from the holder. With the invention, a cap holder apparatus is provided which enables a person to readily ascertain indicia on a cap so as to facilitate selection of a desired cap. With the invention, a cap holder apparatus is provided which enables a person to select whether a mechanical fastener, such as a screw, or an adhesive is used to install the head covering support on a vertical surface. With the invention, a cap holder apparatus is provided which can employ both a mechanical fastener and an adhesive to mount a head covering holder on a vertical surface.

With the invention, a cap holder apparatus is provided which employs a positive clamping action to retain the head covering on the holder. With the invention, a cap holder apparatus is provided which enables a person to install a visor in a visor clamp using a one-handed operation. With the invention, a cap holder apparatus is provided which does not use much material and does not take up much space when not in use. With the invention, a cap holder apparatus is provided which does not employ a complex leverage system for expanding clamping jaws. With the invention, a cap holder apparatus is provided which has a visor-clamping portion that is adapted to clamp onto different visors having different thicknesses. With the invention, a cap holder apparatus is provided which is stackable and could, alternatively, be installed on a closet pole. With the invention, a cap holder apparatus is provided which can be easily installed on a wide variety of racks either mass produced or custom made.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the foregoing Abstract provided at the beginning of this specification is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. A cap holder apparatus, comprising:

a base assembly adapted to be attached to a support surface, said base assembly including a top surface and a bottom surface, a plurality of concentric clamp members in the form of portions of walls of a cylinder projecting from said top surface of said base assembly, each of said clamp members including a arcuate contour for clamping therebetween a complementary arcuate contour on a head covering or cap, said clamp members arrayed on said base assembly such that free ends of said clamp members are concentric to each other, wherein said clamp members are resilient and project from said base assembly such that said free ends of said clamp members converge toward each other, and attaching means for attaching said base assembly to a support surface.

2. The apparatus of claim 1 wherein said base assembly is substantially planar and is adapted to be attached to a substantially planar support surface juxtaposed to said bottom surface of said base assembly.

3. The apparatus of claim 1 wherein said attaching means include apertures in said base assembly adapted to receive a mechanical fastener for attaching said base assembly to a support surface.

4. The apparatus of claim 1 wherein said attaching means include a layer of adhesive material located on said bottom surface of said base assembly.

5. The apparatus of claim 4, further including:

a non-adhesive barrier layer placed upon said layer of material.

6. A cap holder apparatus, comprising:

a base assembly adapted to be attached to a support surface, said bask assembly including a top surface and a bottom surface, a plurality of concentric clamp members in the form of portions of walls of a cylinder projecting from said top surface of said base assembly, each of said clamp members including a arcuate contour for clamping therebetween a complementary arcuate contour on a head covering or cap, said clamp members arrayed on said base assembly such that free ends of said clamp members are concentric to each other, and attaching means for attaching said base assembly to a support surface, wherein said base assembly includes an array of wells, and each of said clamp members includes a peg portion adapted to be inserted into a selected well.

* * * * *